US009408462B1

(12) United States Patent
Hong

(10) Patent No.: US 9,408,462 B1
(45) Date of Patent: Aug. 9, 2016

(54) SUPPORT RACK LOCKING APPARATUS

(71) Applicant: JEONHAN CO., LTD., Eumseong-gun, Chungcheongbuk-do (KR)

(72) Inventor: Jang Sun Hong, Seongnam-si (KR)

(73) Assignee: JEONHAN CO., LTD., Chungcheongbuk-do (KR)

( * ) Notice: Subject to any disclaimer, the term of this patent is extended or adjusted under 35 U.S.C. 154(b) by 0 days.

(21) Appl. No.: 14/796,778

(22) Filed: Jul. 10, 2015

(30) Foreign Application Priority Data

May 1, 2015 (KR) ..... 10-2015-0062291

(51) Int. Cl.

| | |
|---|---|
| ***A47B 57/58*** | (2006.01) |
| ***A47L 15/50*** | (2006.01) |
| ***F24C 15/16*** | (2006.01) |
| ***A47B 96/06*** | (2006.01) |

(52) U.S. Cl.
CPC ..... *A47B 57/585* (2013.01); *A47B 96/067* (2013.01); *A47L 15/507* (2013.01); *F24C 15/168* (2013.01)

(58) Field of Classification Search
CPC ..... F24C 15/16; F24C 15/168; F24C 15/322; A47J 37/0694; A21B 1/44; A47B 57/585; A47B 96/067; A47L 15/507
USPC ..... 211/134
See application file for complete search history.

(56) References Cited

U.S. PATENT DOCUMENTS

2012/0097147 A1 4/2012 Steurer et al.

FOREIGN PATENT DOCUMENTS

KR 10-2010-0084384 A 7/2010

*Primary Examiner* — Korie H Chan
(74) *Attorney, Agent, or Firm* — Novick, Kim & Lee, PLLC; Jae Youn Kim

(57) ABSTRACT

There is provided a support rack locking apparatus, comprising: a support rack attachably or detachably installed at mounting rails provided at both sides in a cavity of a machine body; a shelf rack installed at the support rack to be movable in a forward or backward direction; fixed rail members fixedly installed at both sides of the support rack; movable rail members fixedly installed at both sides of the shelf rack and connected to the fixed rail members, to be forwardly or backwardly movable; a supporting member fixedly installed at the outside of each of the fixed rail members; a locking member pivotally connected with the supporting member by using a hinge connecting pin; and an operating member fixedly installed at each of the movable rail members, to operate the locking member.

7 Claims, 8 Drawing Sheets

SUPPORT RACK LOCKING APPARATUS

CROSS-REFERENCE TO RELATED APPLICATION

This application claims the benefit of Korean Patent Application No. 10-2015-0062291, filed on May 1, 2015, the disclosure of which is hereby incorporated herein by reference in its entirety.

BACKGROUND OF THE INVENTION

1. Field of the Invention

The present invention relates to a support rack locking apparatus, and more particularly, to a support rack locking apparatus wherein a support rack is not drawn out when a shelf rack is drawn out from the inside a machine body.

2. Description of the Related Art

Generally, a home appliance, such as an electric or gas oven, a dish washer, etc., includes a shelf rack on which items, such as prepared food or dishes, are easily put inside the body of a machine and from which the items are easily taken out.

In many examples, shelf racks are installed at support racks so as to move in a forward or backward direction and the support racks are installed so as to be attached to or detached from the body of the machine.

That is, a rack assembly in which the shelf rack is installed at the support rack so as to forwardly or backwardly move is usually installed to be attached to or detached from the body of the machine. In this case, the support rack of the rack assembly is insertedly installed at mounting rails provided on both sides within a cavity forming a cooking space or washing space. A number of pairs of the mounting rails are provided in a vertical direction, to adjust the cooking height or washing height.

When the aforementioned rack assembly is used, the use is easy by sliding only the shelf rack from the body of the machine to put items on or take them out while the support shelf is supported by the body of the machine during the process of cooking or washing.

In addition, when the rack assembly is separated from the body of the machine, it is possible to easily clean the inside of the body of the machine or the rack assembly.

The present invention relates to a support rack locking apparatus to prevent a support rack from being drawn together when a shelf rack is drawn from the support rack attachably and detachably installed in the body of the machine.

Patent Document 1 cited below discloses a rack assembly and an oven including the same.

The rack assembly of Patent Document 1 comprises: a mounting rack to be mounted inside an oven chamber; a slidable rack to be pulled out and pushed into the oven chamber by a sliding motion to the mounting rack; a rail unit enabling the sliding motion of the slidable rack to the mounting rack; holding ribs provided at both ends of the mounting rack, to position the mounting rack at a predetermined height in the oven chamber; and motion preventing ribs provided at the both end of the mounting rack, to prevent the mounting rack from forwardly moving in the oven chamber at least when the slidable rack is slid out.

The rack assembly of Patent Document 1 makes it possible to draw out the slidable rack on which items are put relative to the mounting rack supported by the oven chamber and to prevent the mounting rack from being drawn out together with the slidable rack by using the motion preventing ribs.

Patent Document 2 cited below discloses an extension rack assembly.

In the extension rack assembly of Patent Document 2, a supporting member and a locking member are provided to a fixed rail member which is fixedly installed at a support rack, an operating member is provided to a moving rail member which is fixedly installed at a shelf rack and connected to the fixed rail member so as to be forwardly or backwardly movable by a sliding motion.

In the extension rack assembly of Patent Document 2, when the shelf rack and the moving rail member are slid from the support rack and the fixed rail member supported to a mounting rail inside the body of a machine, the locking member elastically supported through a coil spring is bent towards the side of the cavity, to be stopped in the mounting rail. Accordingly, the support rack and the fixed rail member are not drawn to the outside of the body of the machine, together with the shelf rack and the moving rail member.

RELATED ART DOCUMENT

Patent Document (Patent Document 1) Korean Patent Published Application No. 10-2010-0084384 (laid-open on Jul. 26, 2010)

(Patent Document 2) US Patent Published Application No. US 2012/0097147 A1 (published on Apr. 26, 2012)

However, in a support rack locking apparatus of the extension rack assembly according to Patent Document 2, the coil spring elastically supporting the locking member is likely to be damaged by high heat, etc. in the cavity during use. Further, the coil spring loosens or protrudes so that the machine cannot operate smoothly.

SUMMARY OF THE INVENTION

Therefore, it is an object of the present invention to solve the above problems and to provide a support rack locking apparatus which can be more easily manufactured and is capable of more smoothly locking a support rack without any concern of operational problems.

In accordance with an embodiment of the present invention, there is provided a support rack locking apparatus, comprising: a support rack attachably or detachably installed at mounting rails provided at both sides in a cavity of a machine body; a shelf rack installed at the support rack, to move in a forward or backward direction; fixed rail members fixedly installed at both sides of the support rack; movable rail members fixedly installed at both sides of the shelf rack and connected to the fixed rail members to be forwardly or backwardly movable; a supporting member fixedly installed at the outside of each of the fixed rail members; a locking member pivotally connected with the supporting member by using a hinge connecting pin; and an operating member fixedly installed at each of the movable rail members, to operate the locking member, wherein the supporting member comprises: an elastic supporting piece positioned at the middle of the supporting member and having a front end outwardly protruding; and hinge connecting pieces provided above and under the elastic supporting piece.

The locking member includes a locking section positioned at a front lower section of the locking member; hinge connecting pieces provided at upper and lower positions of an inside rear section of the locking member; and a contact section formed at a top of the inside rear section of the locking member.

The upper one of the hinge connecting pieces of the locking member includes: an outer rim surface to be in contact with the elastic supporting piece of the supporting member; a circular arc being concentric to a hinge connecting aperture in front of the upper hinge connecting piece; and a cam incline in rear of the upper hinge connecting piece.

The contact section of the locking member includes: a triangular protrusion in front of the contact section.

The operating member includes: a fixed section to be fixed to the movable rail member; and a contact protrusion outwardly protruding from the top of the fixed section.

The contact protrusion of the operating member includes: a contact incline formed at the front and rear of the contact protrusion.

BRIEF DESCRIPTION OF THE DRAWINGS

The above and other features and advantages of the present invention will become more apparent to those of ordinary skill in the art by describing in detail the preferred embodiments thereof with reference to the attached drawings in which.

DESCRIPTION OF NUMBERS FOR CONSTITUENTS IN DRAWINGS

Figure 1:
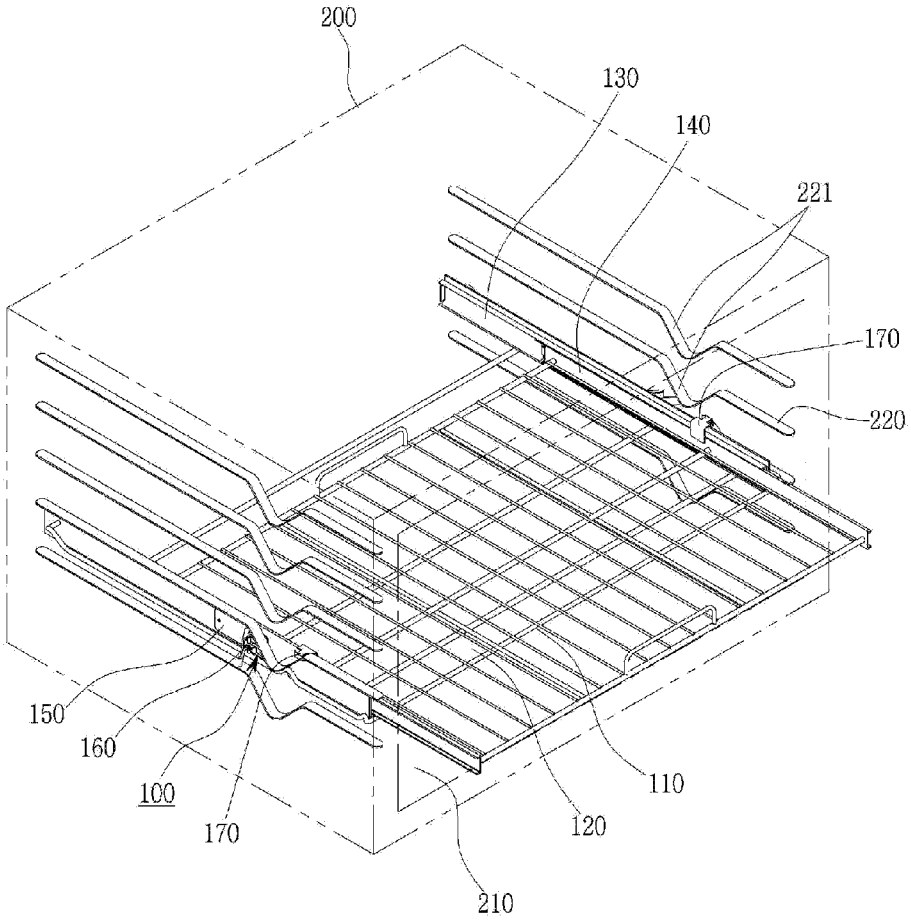
FIG. 1 is a perspective view of a support rack locking apparatus according to a preferred embodiment of the present invention.

100: support rack locking apparatus
110: support rack
120: shelf rack
130: fixed rail member
140: movable rail member
150: supporting member
160: locking member
170: operating member

DETAILED DESCRIPTION OF THE PREFERRED EMBODIMENT

The present invention will now be described more fully hereinafter with reference to the accompanying drawings, in which the preferred embodiment(s) of the invention is shown so that those of ordinary skill in the art can easily carry out the present invention.

It should be understood that, the terms of directional natures, "upward", "downward", "forward", "backward", etc., are defined based on the states illustrated in the drawings.

Figure 2:
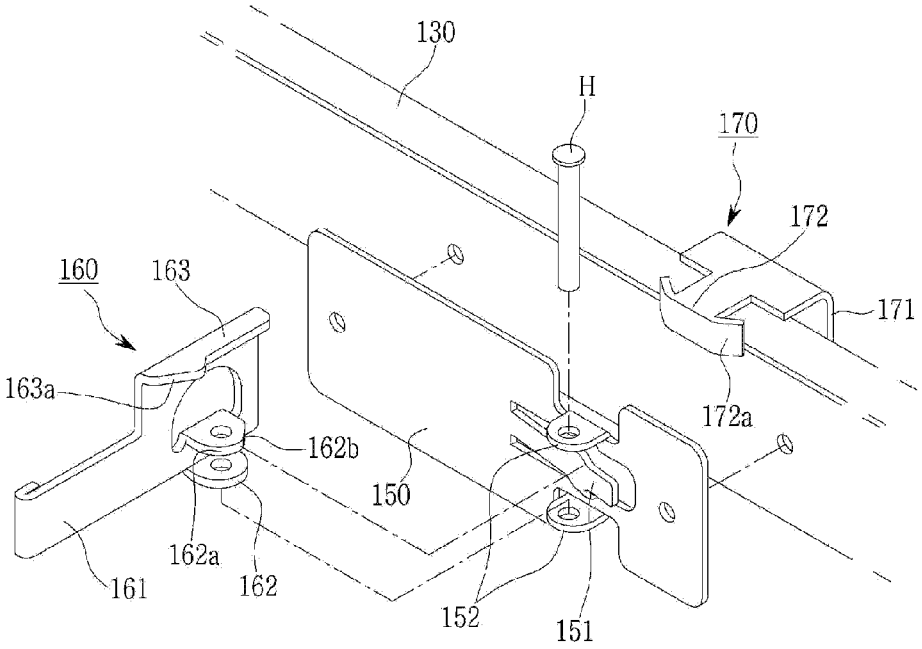
FIG. 2 is an exploded view of main parts of the support rack locking apparatus.

FIG. 1 is a perspective view of a support rack locking apparatus according to a preferred embodiment of the present invention, and FIG. 2 is an exploded view of main parts of the support rack locking apparatus.

A support rack locking apparatus 100 according to the preferred embodiment of the present invention comprises: a support rack 110, a shelf rack 120, a fixed rail member 130, a movable rail member 140, a supporting member 150, a locking member 160 and an operating member 170.

The support rack 110 is to support the shelf rack 120 and is attachably or detachably installed in mounting rails provided both sides in a cavity 210 of a machine body 200.

The shelf rack 120 is used to receive items within the machine body 200 or to take out the items from the machine body 200. The shelf rack 120 is installed on the support rack 110 such that the shelf rack 120 is slidable in a forward or backward direction.

The fixed rail members 130 support the movable rail members 140 and the shelf rack 120 for receiving and taking out the items placed on the self rack 120. The fixed rail members 130 are fixedly installed at both sides of the support rack 110.

The movable rail members 140 are fixedly installed at both sides of the shelf rack 120 and slidably in the forward or backward direction connected to the fixed rail members 130.

The supporting member 150 is to support the pivot of the locking member 160. The supporting member 150 is fixedly installed at the outside of each of the fixed rail member 130.

The supporting member 150 is in a flat shape. The supporting member 150 comprises: an elastic supporting piece 151 and hinge connecting pieces 152. The elastic supporting piece 151 is positioned in the middle of the supporting member 150 and has a front end protruding outwardly. The hinge connecting pieces 152 are positioned above and under the elastic supporting piece 151.

The locking member 160 is to lock the support rack 110 so that the support rack 110 is prevented from being drawn out to the outside of the machine body 200 when the shelf rack 120 is drawn out. The locking member 160 is pivotally connected to the supporting member 150 by a hinge connection pin H.

The locking member 160 comprises: a locking section 161; hinge connecting pieces 162; and a contact section 163. The locking section 161 is a front lower section of the locking member 160. The hinge connecting pieces 162 are positioned at upper and lower positions of an inside rear section of the locking member 160. The contact section 163 is formed at a top of the inside rear section of the locking member 160.

The outer rim surface of the upper one of the hinge connecting pieces 162 is in contact with the elastic supporting piece 151 of the supporting member 150.

A circular arc 162*a* which is concentric to a hinge connecting aperture is provided in the front of the upper hinge connecting piece 162 of the locking member 160 and a cam incline 162*b* is provided in the back thereof.

A triangular protrusion 163*a* is provided in the front of the contact section 163 of the locking member 160.

The operating member 170 to operate the pivot of the locking member 160 is fixedly installed to the movable rail member 140.

The operating member 170 comprises a fixed section 171 to be fixed to the movable rail member 140; and a contact protrusion 172 outwardly protruding from the top of the fixed section 171.

A contact incline 172*a* is formed at an outside front and rear of the contact protrusion 172 of the operating member 170.

A stopping protrusion 221 is provided in the mounting rail 220 described below.

The support rack locking apparatus 100 according to the embodiment of the present invention prevents the support rack 110 from being drawn out together with the shelf rack 120 by locking the support rack 110 when the shelf rack 120 is drawn out from the cavity 210 of the machine body 200.

Figure 3A:
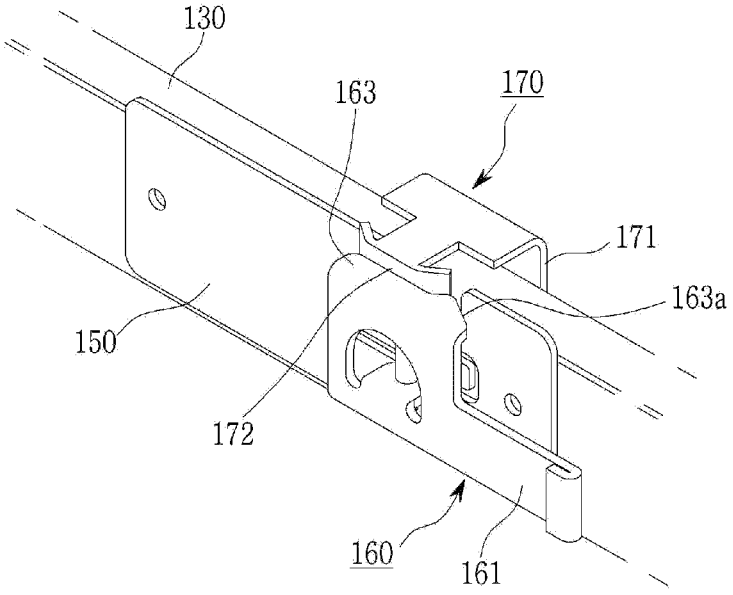
FIG. 3*a* is a perspective view of the main parts of the support rack locking apparatus according to the present invention when a shelf rack is positioned inside a cavity of a machine body.
Figure 3B:
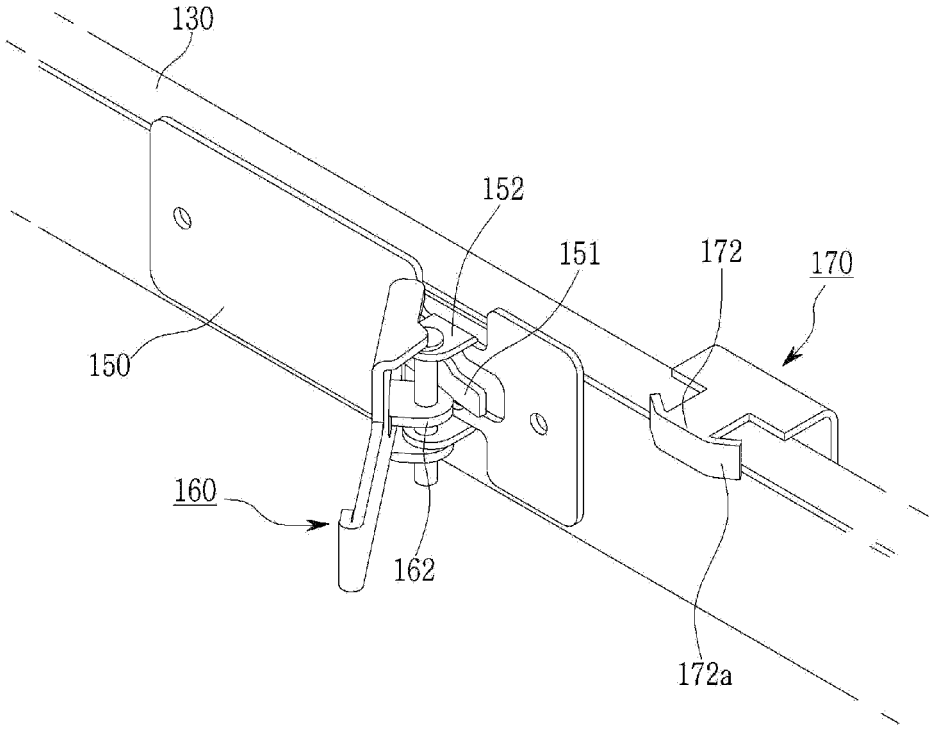
FIG. 3*b* is a perspective view of the main parts of the support rack locking apparatus when the shelf rack is drawn out.

FIG. 3*a* is a perspective view of the main parts of the support rack locking apparatus according to the present invention when the shelf rack is positioned inside showing the movement of the support locking apparatus when the shelf rack moves to the outside; and FIG. 3*b* is a perspective view of the main parts of the support rack locking apparatus when the shelf rack is now in position for being drawn out after positioned inside.

Figure 4A:
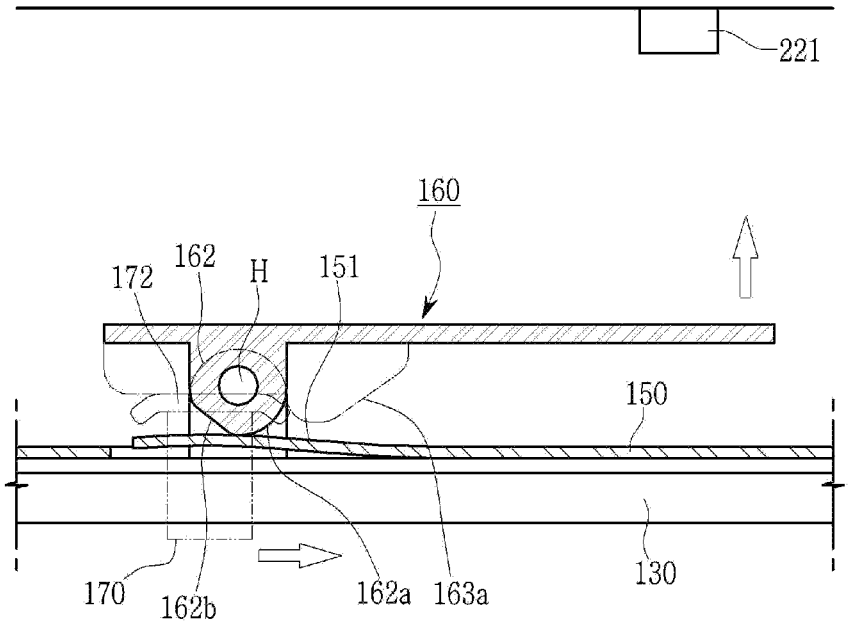
FIG. 4*a* is a cross-sectional view of the main parts of the support rack locking apparatus when the shelf rack is positioned inside.
Figure 4B:
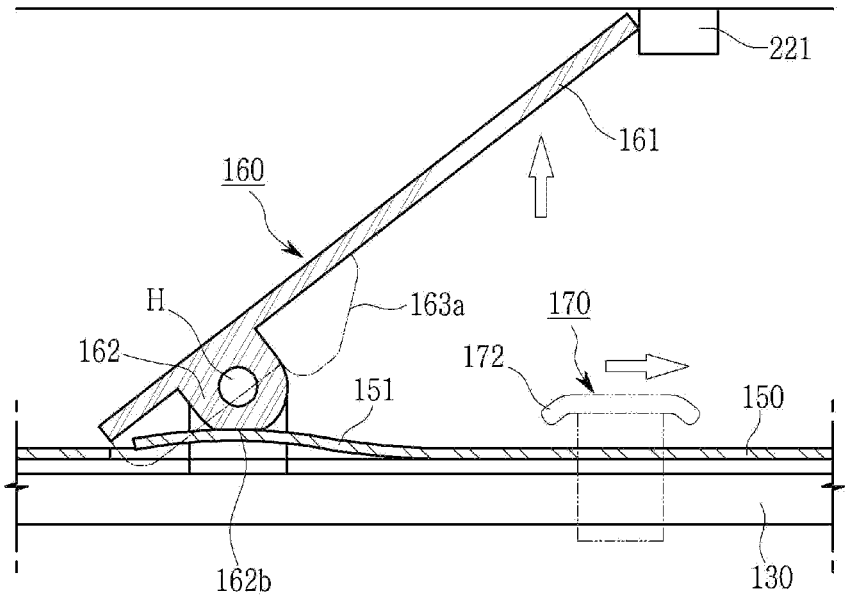
FIG. 4*b* is a cross-sectional view of the main parts of the support rack locking apparatus when the shelf rack is drawn out.

FIG. 4*a* is a cross-sectional view of the main parts of the support rack locking apparatus of FIG. 3*a*; and FIG. 4*b* is a cross-sectional view of the main parts of the support rack locking apparatus of FIG. 3*b*.

As shown in FIGS. 3*a*, 3*b*, 4*a* and 4*b*, when the movable rail member 140 fixedly installed at the shelf rack 120 is positioned in the fixed rail member 130 fixedly installed at the support rack 110, the contact protrusion 172 of the operating member 170 installed at the movable rail member 140 is positioned at the rear of the triangular protrusion 163*a* of the contact section 163 of the locking member 160, so that the locking section 161 of the locking member 160 cannot pivot to the outside of the locking section 161.

The outside of the locking section 161 means the inner wall of the cavity 210.

In the state that where the shelf rack 120 is positioned inside, the support rack 110 and the shelf rack 120 together enter into the cavity 210 of the machine body 200 to be positioned in the mounting rails 220, or the support rack 110 is separated from the mounting rails 220 to be drawn out of the machine body 200.

In the state that where the support rack 110 and the shelf rack 120 are positioned inside the cavity 210 of the machine body 200, when the shelf rack 120 is pulled forward to load items on the shelf rack 120, it drawn out of the machine body 200, together with the movable rail members 140.

When the shelf rack 120 and the movable rail members 140 are drawn out from the cavity 210, the contact protrusion 172 of the operating member 170 fixedly installed at the movable rail member 140 pushes the triangular protrusion 163*a* of the contact section 163 of the locking member 160 and therefore the locking section 161 of the locking member 160 elastically supported by the elastic supporting piece 151 of the supporting member 150 pivots towards the inner wall of the cavity 210. Accordingly, as shown in FIG. 4*b*, the front end of the locking section 161 of the locking member 160 is stopped by the stopping protrusion 221 of the mounting rail 220 of the cavity 210.

In this manner, when the shelf rack 120 is drawn out from the cavity 210, together with the movable rail members 140, the support rack 110 and the fixed rail members 130 are not drawn out from the cavity 210.

Figure 5A:
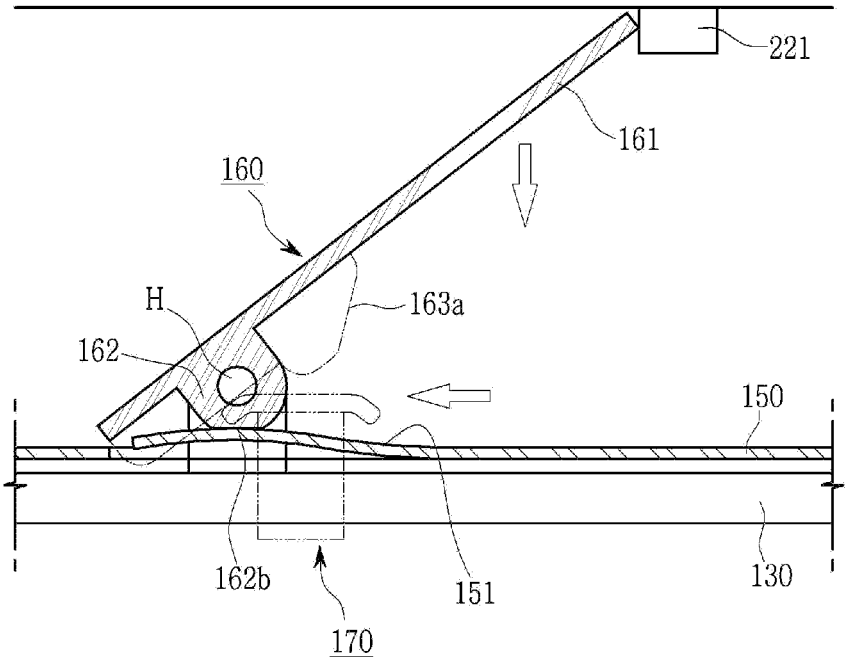
FIG. 5*a* is a cross-sectional view of the main parts of the support rack locking apparatus when the shelf rack is going to be positioned inside after it has been drawn out.
Figure 5B:
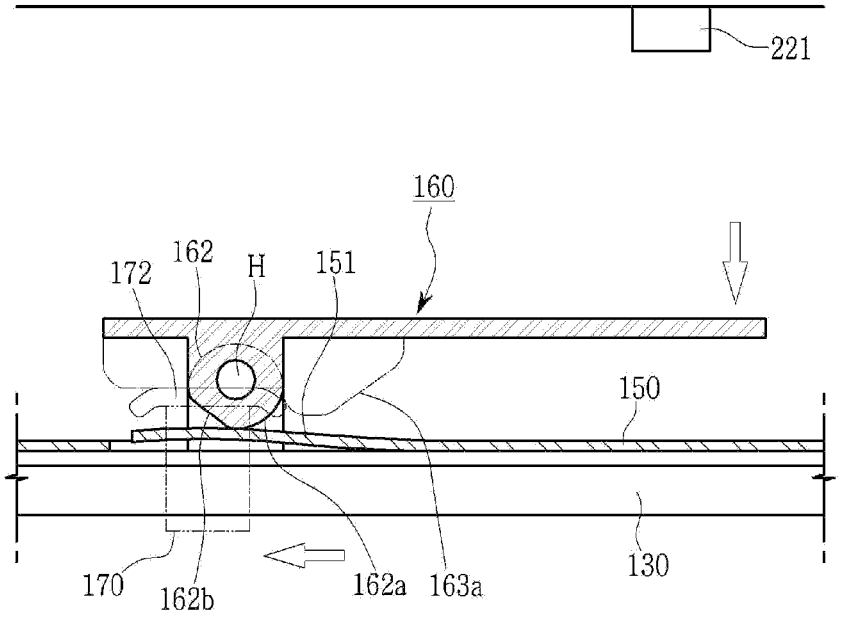
FIG. 5*b* is a cross-sectional view of the main parts of the support rack locking apparatus when the shelf rack having been drawn out is now positioned inside.

FIG. 5*a* is a cross-sectional view of the main parts of the support rack locking apparatus when the shelf rack is going to be positioned inside showing the movement of the support rack locking apparatus when the shelf rack moves to the inside; and FIG. 5*b* is a cross-sectional view of the main parts of the support rack locking apparatus when the shelf rack having been drawn out is now positioned inside.

In the process of pushing the shelf rack 120 back into the cavity 210 after loading items on the shelf rack 120 which has been drawn out from the cavity 210, as shown in FIG. 5*a*, the contact protrusion 172 of the operating member 170 which moves backward together with the movable rail member 140 pushes the contact section 163 of the locking member 160. Accordingly, the locking section 161 of the locking member 160 pivots inward, to be out of the stopping protrusion 221 of the mounting rail 220 of the cavity 210.

When the shelf rack 120 which has been drawn out is positioned inside, as shown in FIG. 5*b*, the contact protrusion 172 of the operating member 170 is positioned at the rear of the triangular protrusion 163*a* of the contact section 163 of the locking member 160 and therefore the locking section 161 of the locking member 160 cannot pivot outwardly.

According to the support rack locking apparatus 100 of the present invention as described above, since the support rack 110 is locked when the shelf rack 120 is drawn from the cavity 210 of the machine body 200, it is possible to safely put items on the shelf rack 120 or to safely take out the items from the shelf rack 120.

Furthermore, according to the support rack locking apparatus 100 of the present invention, when the shelf rack 120 which has been drawn is positioned inside the cavity 210 of the machine body 200, the locking state of the support rack 110 is released and the support rack 110 can be drawn out of the cavity 210 of the machine body 200, together with the shelf rack 120.

The invention has been described using preferred exemplary embodiments. However, it is to be understood that the scope of the invention is not limited to the disclosed embodiments. On the contrary, the scope of the invention is intended to include various modifications and alternative arrangements within the capabilities of persons skilled in the art using presently known or future technologies and equivalents. The scope of the claims, therefore, should be accorded the broadest interpretation so as to encompass all such modifications and similar arrangements.

What is claimed is:

1. A support rack locking apparatus, comprising:

a support rack attachably or detachably installed at mounting rails disposed at both sides inside a cavity of a machine body;

a shelf rack installed at the support rack, to be movable in a forward or backward direction;

fixed rail members fixedly installed at both sides of the support rack;

movable rail members fixedly installed at both sides of the shelf rack and connected to the fixed rail members, to be forwardly or backwardly movable;

a supporting member fixedly installed at the outside of each of the fixed rail members;

a locking member pivotally connected with the supporting member by using a hinge connecting pin; and an operating member fixedly installed at each of the movable rail members, to operate the locking member, wherein the supporting member comprises: an elastic supporting plate positioned in the middle of the supporting member and having a front end outwardly protruding; and hinge connecting pieces disposed above and under the elastic supporting plate.

2. The support rack locking apparatus of claim 1, wherein the locking member includes:

a locking section positioned at a front lower section of the locking member;

hinge connecting pieces disposed at upper and lower positions of an inside rear section of the locking member; and a contact section formed at a top of the inside rear section of the locking member.

3. The support rack locking apparatus of claim 2, wherein the upper one of the hinge connecting pieces of the locking member includes:

an outer rim surface to be in contact with the elastic supporting plate of the supporting member;

a circular arc being concentric to a hinge connecting aperture in front of the upper hinge connecting piece; and a cam incline in rear of the upper hinge connecting piece.

4. The support rack locking apparatus of claim 2, wherein the contact section of the locking member includes: a triangular protrusion in front of the contact section.

5. The support rack locking apparatus of claim 3, wherein the contact section of the locking member includes: a triangular protrusion in front of the contact section.

6. The support rack locking apparatus of claim 1, wherein the operating member includes:

a fixed section to be fixed to the movable rail member; and a contact protrusion outwardly protruding from the top of the fixed section.

7. The support rack locking apparatus of claim 6, wherein the contact protrusion of the operating member includes: a contact incline formed at an outside front and rear of the contact protrusion.

* * * * *